US008529214B2

(12) United States Patent
Smith

(10) Patent No.: US 8,529,214 B2
(45) Date of Patent: Sep. 10, 2013

(54) VARIABLE SPEED PROGRESSING CAVITY PUMP SYSTEM

(75) Inventor: Michael E. Smith, Conroe, TX (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 436 days.

(21) Appl. No.: 12/722,130

(22) Filed: Mar. 11, 2010

(65) Prior Publication Data

US 2011/0223037 A1 Sep. 15, 2011

(51) Int. Cl.
*F04B 49/00* (2006.01)

(52) U.S. Cl.
USPC ..... 417/18; 417/12; 417/20; 417/43

(58) Field of Classification Search
USPC ..... 417/12, 18, 20, 43; 166/250.15; 700/282
See application file for complete search history.

(56) References Cited

U.S. PATENT DOCUMENTS

| | | | | |
|---|---|---|---|---|
| 4,076,458 | A | 2/1978 | Jones | |
| 4,125,163 | A | 11/1978 | Fitzpatrick | |
| 4,145,161 | A | 3/1979 | Skinner | |
| 4,318,674 | A | 3/1982 | Godbey et al. | |
| 4,389,164 | A | 6/1983 | Godbey et al. | |
| 4,661,751 | A | 4/1987 | Werner | |
| 4,738,313 | A | 4/1988 | McKee | |
| 4,854,164 | A | 8/1989 | Rhoads | |
| 4,973,226 | A | 11/1990 | McKee | |
| 5,044,888 | A | 9/1991 | Hester, II | |
| 5,064,348 | A | 11/1991 | McKee et al. | |
| 5,167,490 | A | 12/1992 | McKee et al. | |
| 5,251,696 | A | 10/1993 | Boone et al. | |
| 5,525,040 | A | 6/1996 | Andreae et al. | |
| 5,603,608 | A | 2/1997 | Marz | |
| 5,742,500 | A * | 4/1998 | Irvin | 700/9 |
| 5,782,608 | A | 7/1998 | McKee | |
| 5,941,305 | A | 8/1999 | Thrasher et al. | |
| 5,984,641 | A | 11/1999 | Bevan et al. | |
| 6,077,044 | A * | 6/2000 | Reid | 417/2 |
| 6,155,347 | A | 12/2000 | Mills | |
| 6,178,393 | B1 * | 1/2001 | Irvin | 703/10 |
| 6,340,243 | B1 | 1/2002 | Deane et al. | |
| 6,481,973 | B1 * | 11/2002 | Struthers | 417/36 |
| 6,536,522 | B2 | 3/2003 | Birckhead et al. | |
| 6,604,582 | B2 * | 8/2003 | Flowers et al. | 166/332.1 |
| 6,873,267 | B1 | 3/2005 | Tubel et al. | |

(Continued)

FOREIGN PATENT DOCUMENTS

CA 2220606 5/1999

OTHER PUBLICATIONS

PCT, International Search Report and Written Opinion, International Application No. PCT/US2011/026005 (Apr. 19, 2011).

(Continued)

*Primary Examiner* — Charles Freay
*Assistant Examiner* — Ryan Gatzemeyer
(74) *Attorney, Agent, or Firm* — Thompson Hine L.L.P.

(57) ABSTRACT

A pump system including a pump and a sensor system for monitoring a fluid production of the pump and providing an output indicative of the fluid production. The sensor system is configured to use at least two discreet methodologies for measuring the fluid production. The pump system further includes a control system operatively coupled to the sensor system and the pump and configured to automatically vary the speed of the pump at least partially based upon the output of the sensor system.

25 Claims, 6 Drawing Sheets

(56) References Cited

U.S. PATENT DOCUMENTS

| | | | | |
|---|---|---|---|---|
| 7,314,349 | B2 | 1/2008 | Mills | |
| 7,330,797 | B2 | 2/2008 | Bailey et al. | |
| 7,348,893 | B2 * | 3/2008 | Huang et al. | 340/854.3 |
| 7,668,694 | B2 | 2/2010 | Anderson et al. | |
| 7,677,320 | B2 * | 3/2010 | Shaw et al. | 166/368 |
| 7,870,900 | B2 * | 1/2011 | Dorado et al. | 166/250.15 |
| 7,901,190 | B2 * | 3/2011 | Gray | 417/22 |
| 2002/0106280 | A1 * | 8/2002 | Beard et al. | 417/3 |
| 2002/0182089 | A1 * | 12/2002 | Marvel et al. | 417/244 |
| 2006/0048947 | A1 * | 3/2006 | Hall et al. | 166/377 |
| 2007/0289747 | A1 * | 12/2007 | Shaw et al. | 166/368 |
| 2008/0288115 | A1 * | 11/2008 | Rusnak et al. | 700/282 |
| 2008/0317608 | A1 * | 12/2008 | Gray | 417/300 |
| 2009/0068024 | A1 | 3/2009 | Amburgey et al. | |
| 2009/0129942 | A1 | 5/2009 | Dorado et al. | |
| 2009/0202359 | A1 * | 8/2009 | Duncan | 417/43 |
| 2009/0214357 | A1 | 8/2009 | Galley | |
| 2010/0101022 | A1 * | 4/2010 | Riley et al. | 5/600 |
| 2012/0087804 | A1 * | 4/2012 | Mott | 417/12 |
| 2012/0195770 | A1 * | 8/2012 | Anderson et al. | 417/18 |

OTHER PUBLICATIONS

Product Literature entitled, "Moyno® Down-Hole Pump Systems. Proven Performers in Coalbed Methane Applications," by R&M Energy Systems (2003).

Excerpt from "Dynasonics® Fusion® Water Flow Meter," pp. 8-10 (2009).

* cited by examiner

VARIABLE SPEED PROGRESSING CAVITY PUMP SYSTEM

The present invention is directed to a pump system, and more particularly, to a variable speed progressing cavity pump system and a method for varying the speed of a progressing cavity pump.

BACKGROUND

Progressing cavity pumps are often used in settings in which the speed and operation of the pump must be carefully controlled. For example, when a progressing cavity pump is used in a down-hole operation, the speed and torque of the pump are often manually controlled to ensure that the pump is operating efficiently, and is not running in the pumped-off condition.

SUMMARY

In one embodiment, the present invention is a progressing cavity pump system in which the output or production of the pump is monitored to ensure that the pump is not operated in the pumped off condition, while the pump is simultaneously monitored and/or controlled to maximize pump efficiency. More particular, in one embodiment, the invention is a pump system including a pump and a sensor system for monitoring a fluid production of the pump and providing an output indicative of the fluid production. The sensor system is configured to use at least two discreet methodologies for measuring the fluid production. The pump system further includes a control system operatively coupled to the sensor system and to the pump and configured to automatically vary the speed of the pump at least partially based upon the output of the sensor system.

In another embodiment, the invention is a pump system including a pump and a sensor configured to sense a fluid production of the pump and provide an output indicative of the fluid production. The pump system further includes a control system operatively coupled to the pump for automatically varying the speed of the pump at least partially based upon the output of the sensor system. The control system is configured to increase the speed of the pump after a predetermined period of time has elapsed, or at a predetermined time, and to subsequently decrease the speed of the pump after the increase if the output of the sensor indicates that the pump is not producing fluid at a sufficient rate.

DETAILED DESCRIPTION

Figure 1:
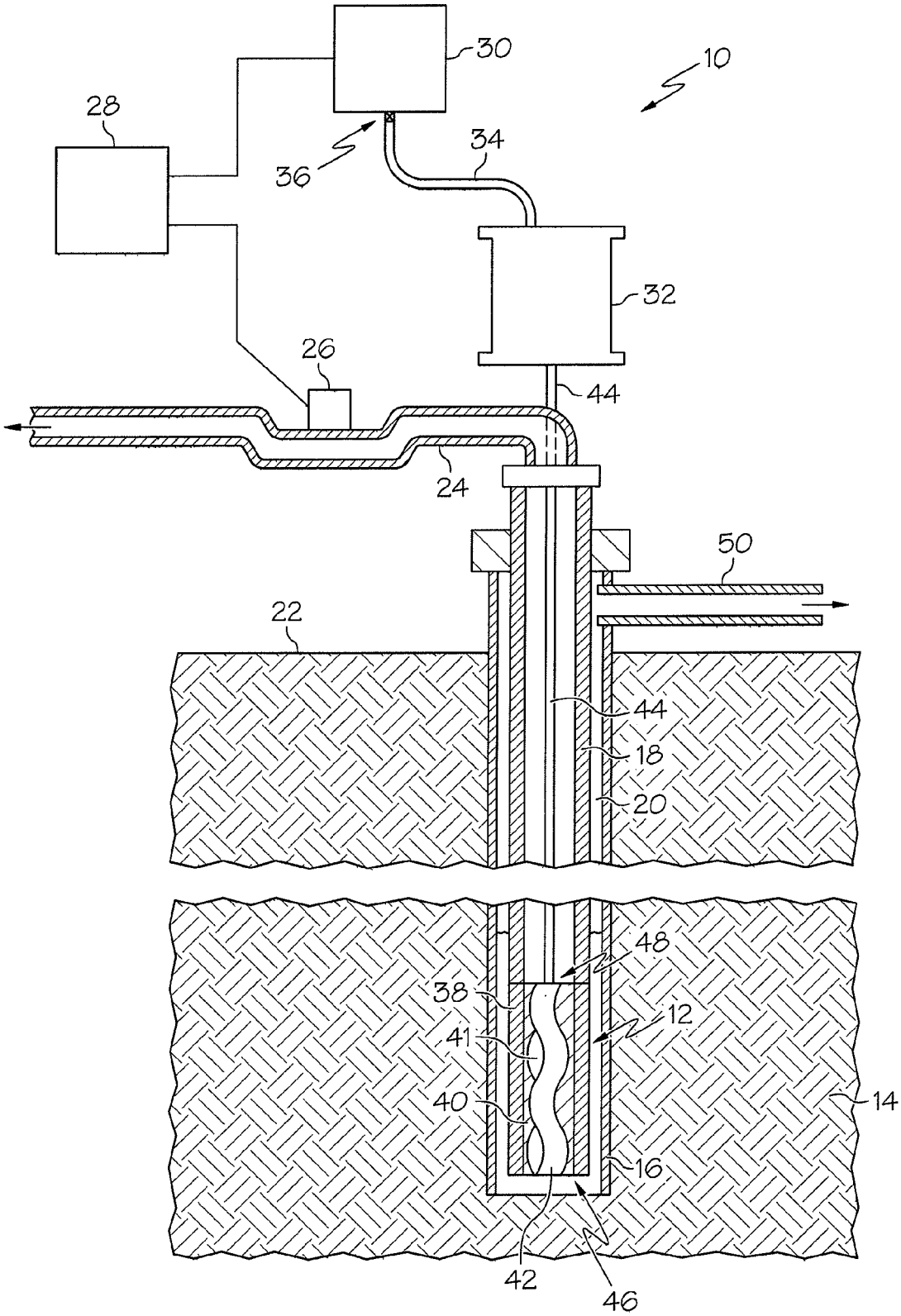
FIG. 1 is a schematic view of one embodiment of the pump system of the present invention.

As shown in FIG. 1, in one embodiment, the pump system 10 includes a progressing cavity pump 12 positioned in or adjacent to a formation 14 which contains a substance desired to be extracted, such as oil, methane, natural gas, etc. The pump system 10 includes a well casing 16 which receives production tubing 18 disposed therein, with an annulus 20 formed therebetween. The progressing cavity pump 12 is positioned down hole in or adjacent to the production tubing 18 to pump fluid from the annulus 20 upwardly to the surface 22. Pumped fluid passes through an outflow line 24 and then downstream for further processing as desired.

A flow meter, flow sensor or sensor system 26 is positioned in the outflow line 24 to measure the velocity and/or flow rate of pumped fluid. A controller 28, such as a CPU, microprocessor, processor, computer or the like is operatively coupled to the flow meter 26. The controller 28 is, in turn, operatively coupled to the pump 12 to control speed and operation of the pump 12. In the illustrated embodiment, the pump 12 is hydraulically driven and includes a hydraulic power plant or hydraulic pump 30 coupled to a hydraulic pump head, or hydraulic motor 32, by a hydraulic fluid line 34. In this manner, the controller 28 can control the pump 12 by sending command signals to the hydraulic pump 30.

In order to operate the pump system 10, the hydraulic pump 30 provides pressurized hydraulic fluid (pressurized by a driver motor (not shown) which can be a gasoline motor, an electric motor, etc.) to the hydraulic motor 32. In order to vary the speed and/or torque of the motor 32, and thereby the pump, in one embodiment a control valve or swash plate 36 is provided at the output of the hydraulic pump 30 to restrict the volume and/or pressure of the hydraulic fluid which necessarily restricts the speed of the hydraulic motor 32 and pump 12. The open/closed state of the valve or swash plate 36 on the hydraulic pump 30 thus controls the speed and/or torque of the hydraulic motor 32. In this manner, the speed of the hydraulic motor 32 can be regulated from 0% to 100% of the hydraulic motor's capable speed. The controller 28, control valve/swash plate 36 and flow meter 26 may be powered by the driver motor, by service power, by a battery associated with the hydraulic motor 30, or by some other source.

The driver motor/hydraulic pump 30 may run at a constant speed, and in this case the swash plate 36 is utilized to vary the output of the hydraulic pump 30. In an alternate embodiment, however, the speed of the driver motor/hydraulic pump 30 may be directly varied and in this case the swash plate 34 may not be utilized. Moreover, it should be understood that the pump system 10 need not necessarily be hydraulically driven, and could also be operated by other means, such as by an electric motor including a variable speed electric motor or the like, which would replace the hydraulic pump 30 and hydraulic motor 32 in a well-known manner.

In one embodiment, the progressing cavity pump 12 includes a generally cylindrical stator tube 38 having a stator 40 located therein. The stator 40 has a opening or internal bore 41 extending generally axially or longitudinally therethrough in the form of a double lead helical nut to provide an internally threaded stator 40. The pump 12 includes an externally threaded rotor 42 in the form of a single lead helical screw rotationally received inside the stator 40. The rotor 42 may include a single external helical lobe, with the pitch of the lobe being twice the pitch of the internal helical groove of the stator 40. The rotor 42 and stator 40 can be made of any of a wide variety of materials, including metals and/or elastomers that are chemically inert and wear resistant.

The rotor 42 fits within the stator bore 41 to define a plurality of cavities therebetween. The rotor 42 is rotationally coupled to a drive shaft 44 which is rotationally coupled to the motor 32. When the motor 32 rotates the drive shaft 44, the rotor 42 is rotated about its central axis and thus eccentrically rotates within the stator 40. As the rotor 42 turns within the stator 40, the cavities progress from the inlet or suction end of the pump 46 to an outlet or discharge end 48 of the pump 12, causing fluids adjacent to the pump inlet 46 to be pumped upwardly to the production tubing 18, and ultimately to the outflow line 24.

By way of example, the pump system 10 disclosed herein may be used in the production of methane gas from in situ coal seams. Such pumping operations typically require the removal of water from the coal formation. Once the water is removed, methane gas will be released from the producing region. A low pressure source, or suction source (not shown), may be applied to the annular space 20 of the pump system 10 (via tubing 50, for example) to extract methane gas from the formation, or the methane may naturally rise out of the annulus 20 and be captured.

When the pump 12 is pumping liquids, such as water, therethrough, such liquids provide cooling and lubrication to the pump 12. Water evacuated from the well/annulus 20 is typically replaced with water flowing into the annulus 20 from the surrounding formation. If the pump 12 evacuates water at a rate that exceeds the rate that water reenters the producing region/annulus 20, eventually the liquid in the annulus 20 will be sufficiently evacuated such that the pump 12 will start pumping gas. Excessive gas in the pump 12 can lead to overheating of, and potential damage to, the pump 12. Moreover, pumping of gas by the pump 12 prevents capture of the pumped gas, and can damage equipment due to the rapid expansion of gas as it is raised from the well to surface atmospherical pressure. Accordingly, optimal production is achieved is when water is removed from the producing region/annulus 20 at the same rate that water enters the annulus 20.

In addition, it is generally desired to extract water at the maximum practical rate (without extracting gas) since extraction of water tends to also accelerate the production of gas. Extraction of the water depressurizes the extraction site, and allows the gas to be released into the pump 12. Thus, it is desired to operate the pump 12 to maintain the lowest liquid level possible in the annulus 20, yet without pumping any gas.

The flow meter 26 is configured to monitor the output/production of the pump 12, such as fluid velocity and/or rate of fluid being extracted by the pump 12. As noted above, the output of the flow meter 26 is provided to the controller 28 to aid in controlling operation of the pump 12. In one embodiment, the flow meter 26 is a dual mode flow meter which utilizes two discreet methodologies for monitoring the fluid output.

For example, in one particular embodiment, the dual mode sensor 26 utilizes both ultrasonic and Doppler flow measurement methods. Ultrasonic flow measurement methods are typically most effective in measuring liquid that lacks significant amounts of gas and/or solids. On the other hand, Doppler flow measurement methods may be more effective in measuring liquid that has gas and/or solids dissolved, mixed or carried therein. In the extraction of water for recovering methane gas, solids such as paraffin, sand or other impurities, along with gasses such as methane, air, etc., may be included in the pumped liquid. Thus, as shown in FIG. 2, the dual mode flow meter 26 can include an ultrasonic flow meter portion 52 and a Doppler flow meter portion 54 to best accommodate both types of flow.

The ultrasonic flow meter portion 52 may include a pair of ultrasonic sources 56*a*, 56*b*, and a pair of ultrasonic detectors 58*a*, 58*b*, spaced along the length of the outflow pipe 24. Ultrasonic source 56*a* provides a output pulse sent in the flow direction which is sensed by ultrasonic detector 58*a*. Conversely, ultrasonic source 56*b* provides an output pulse in a direction opposite to the fluid flow which is sensed by ultrasonic detector 58*b*. The time required for each pulse to travel from the source 56*a*, 56*b* to the associated detector 58*a*, 58*b* is tracked. The difference between the travel time for the pulses can be determined to measure the speed of the fluid. The ultrasonic flow meter portion 52 shown in FIG. 2 includes ultrasonic sources 56*a*, 56*b* and detectors 58*a*, 58*b* positioned internally of the outflow pipe 24. However, if desired, non-intrusive or "clamp-on" ultrasonic flow meters may be utilized and mounted on the outside of the outflow pipe 24.

The Doppler flow meter portion 54 can take the form of an acoustic Doppler velocimeter ("ADV") which records instantaneous velocity components at a single point. The Doppler flow meter portion may include a probe head with one transmitter 58 and a number of receivers 60*a*, 60*b*, 60*c*, 60*d*. A beam of electromagnetic radiation, such as a laser, an ultrasonic beam or the like, is emitted from the transmitter 58, and reflects off solid particles or bubbles in the fluid, turbulence in the fluid, etc. The frequency of the reflected beams is then sensed by the receivers 60*a*, 60*b*, 60*c*, 60*d*, and the velocity of the fluid can be calculated by determining the Doppler shift effect.

Figure 2:
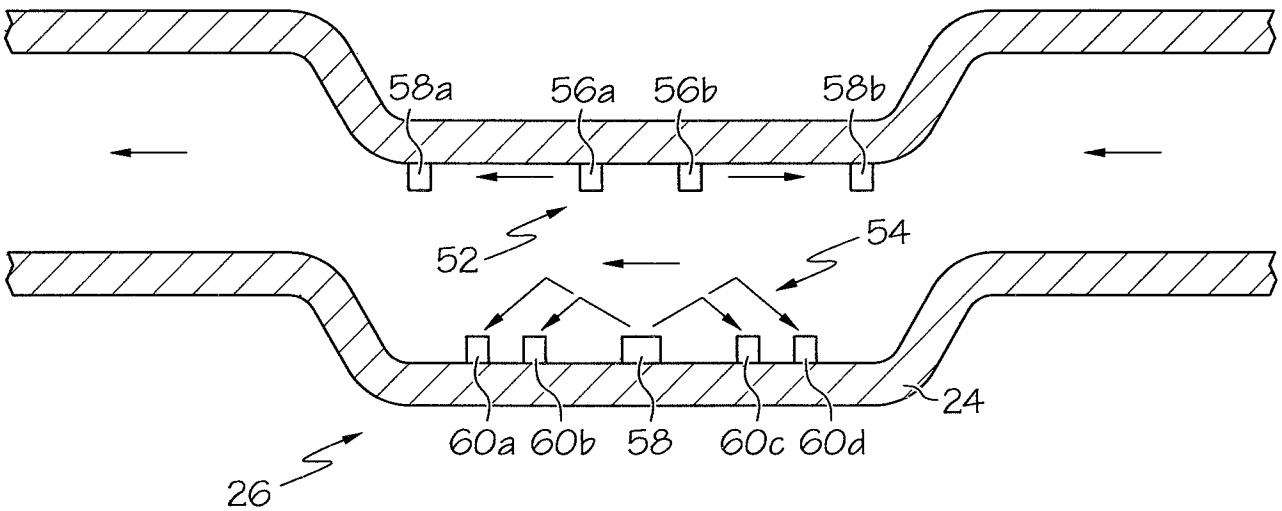
FIG. 2 is a schematic representation of a flow meter usable in the pump system of FIG. 1.

As shown in FIG. 2, the flow meter 26 may be installed at a relatively low point of the pipe 24 to ensure the pipe 24 is typically completely filled with liquid during operation. Each flow meter portion 52, 54 may measure the speed of the liquid, and the flow rate can then be determined when the cross sectional area of the outflow pipe portion 24 is known. The sensor 26 may be configured to detect the presence of gas when a lack of fluid, or lack of a fluid velocity, is detected. Although not shown in FIGS. 1 and 2, the dual mode sensor 26, and the individual sensor components, can be threaded into the pipe 24 such that the dual mode sensor 26, or parts thereof, can be easily replaced as desired.

The signal to-noise ratio or signal output strength for both flow meter portions/methodologies 52, 54 may be tracked. In one case, both fluid sensing methodologies/flow meter portions 52, 54 are utilized simultaneously, and their outputs are monitored. If it appears that both sensor portions 52, 54 are providing reliable outputs (i.e., based upon their signal-to-noise ratio), the output of one or both sensor portions 52, 54 may be utilized (i.e., the readings of the sensors 52, 54 may be averaged, weighted, etc.). Alternately, the output of one of the sensors 52, 54 may be utilized until its output becomes unreliable. For example, in some scenarios Doppler fluid velocity measurements may be deemed more reliable, and therefore the output of the Doppler sensor portion 54 may be utilized as the default output of the sensor 26 until its output is deemed unreliable. At that point, the output of the ultrasonic fluid flow sensor portion 52, or some combination, average or weighted average of the sensor portions 52, 54, may be utilized.

As noted above, the use of the dual flow meter 26 allows the speed of the fluid to be determined by the single best source for a particular fluid flow, or by a combinations of sensors. In this manner, the system can achieve an optimum measurement of fluid speed and flow rate across a spectrum of flow conditions. Although the dual mode meter 26 is described in conjunction with ultrasonic and Doppler fluid speed measurement sensors/methodologies, it should be understood that the flow sensor 26 is not necessarily limited to those particular sensors/methodologies, and other sensors/methodologies for determining fluid flow, such as turbines, flowmeters, heat/temperature sensors (such as hot wire anemometers), pressure sensors (such as pressure anemometers, pitot tubes, venturi tubes, etc.), force sensors, particle image velocimetry, electromagnetic flowmeters, positive displacement flowmeters, coriolis flowmeters, etc., can be used without departing from the scope of the invention. In addition, more than two sensor portions or fluid methodologies, such as three, four, or more, may be used in the flow meter 26.

If desired, the pump system 10 may be operated manually. In this scenario, the pump operator may monitor the operating characteristics of the pump 12, such as its speed, torque, amount of fluid output, fluid output rate, and adjust the speed/torque accordingly. In this case, the controller 28 may have a manual mode allowing such manual control. The controller 28 may also have an automatic mode in which operation of the pump 12/pump system 10 is controlled automatically, such as by the algorithm described below and shown in FIG. 3 which can be implemented in the controller 28 in the form of computer-readable instructions embodied in software, hardware, or some combination thereof.

Figure 3A:
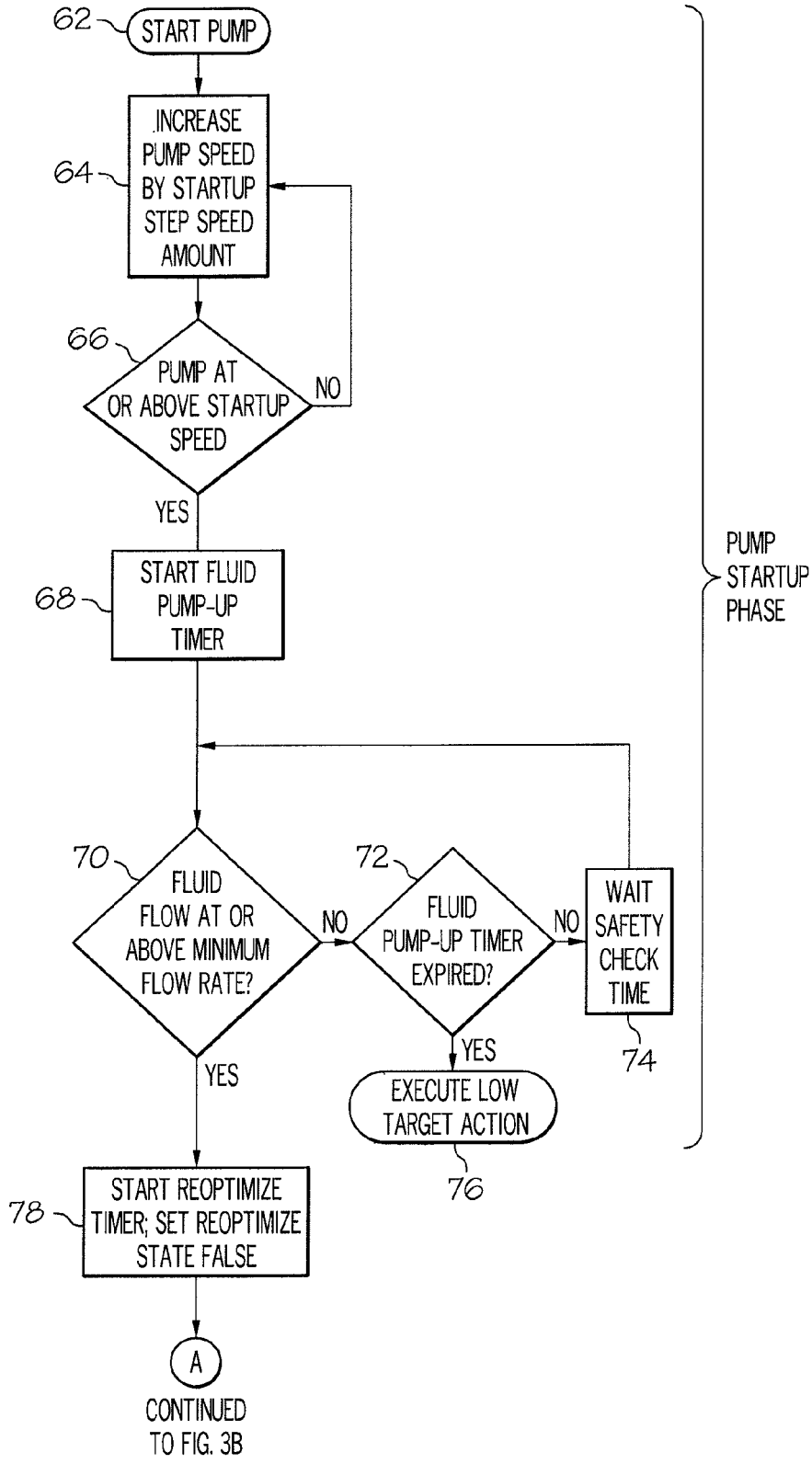
FIG. 3 (broken into FIGS. 3A and 3B) is a flow chart illustrating an algorithm for controlling a pump system such as the system of FIG. 1.
Figure 3B:
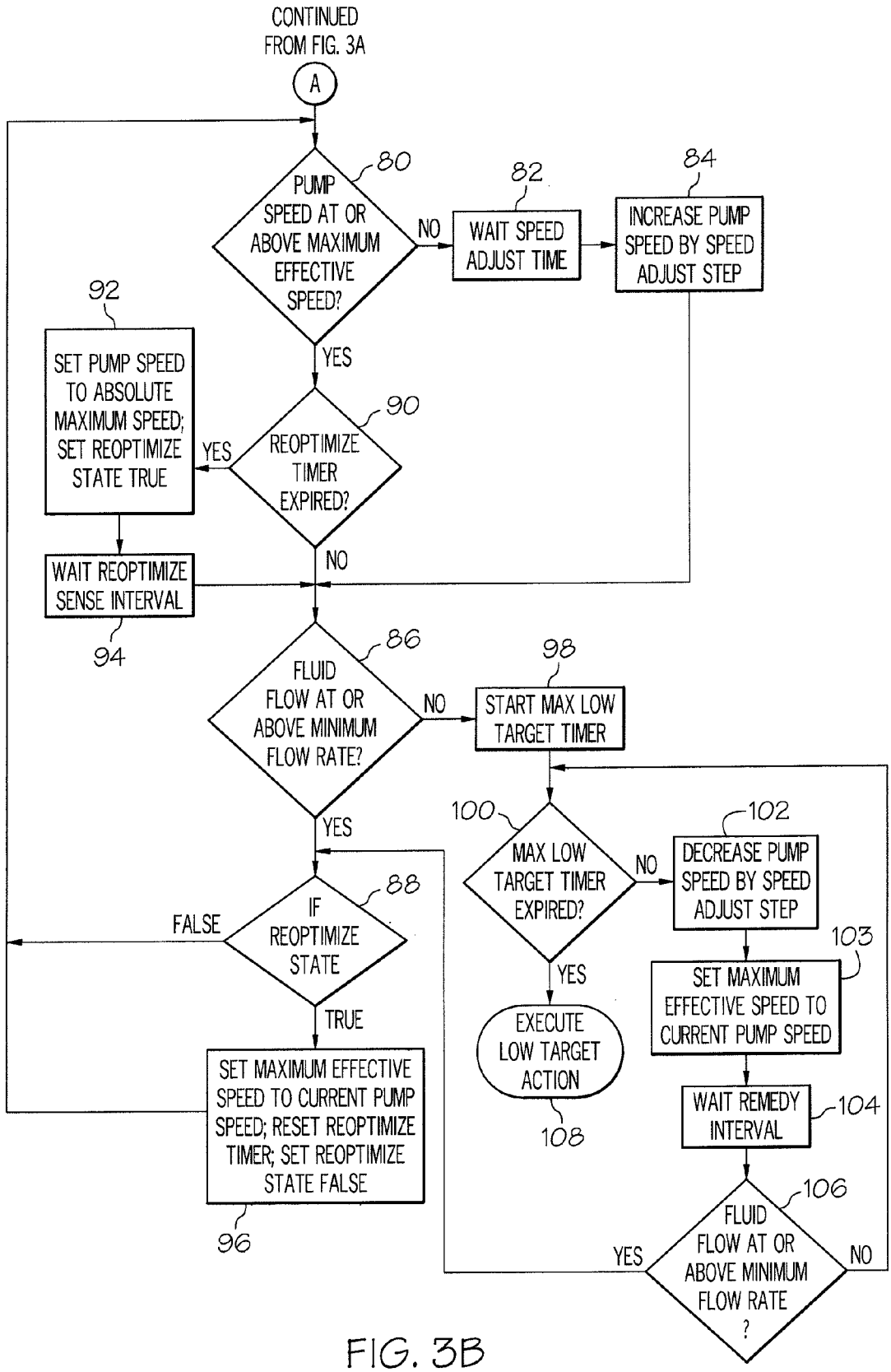

In general, the algorithm of FIG. 3 seeks to first ramp up operation of the pump 12 (during the pump's start up phase), and then seeks to operate the pump 12 to ensure that at least a minimum flow of liquid is being generated. The operation of the pump 12 is periodically boosted to its absolute maximum speed, while the amount of fluid output by the pump 12 is monitored. If it appears that the pump 12 is extracting fluid too rapidly after the speed boost (or at any time during operation), then the pump speed is decreased until sufficient fluid flow is generated.

In particular, with reference to FIG. 3, it can be seen that at step 62 the pump 12 is started, and at step 64 the speed of the pump 12 is increased by step amounts until the pump 12 reaches its start up speed, as examined at step 66. The start up speed can vary depending upon the nature of the pump 12, the nature of the pump system 10, the desires of the pump/well operator, the material being pumped, ambient conditions, etc. However, for the case of one particular illustrative example, which is further described below in association with FIG. 3, the start-up speed can be between about 50-200 rpm.

Next, at step 68, the fluid pump up timer is started, and, at step 70, the fluid flow rate is compared to a minimum fluid flow rate (also termed the "feedback target" flow rate). In one case, the fluid flow rate is determined by the flow meter, such as the dual mode flow meter 26 described above. However, it should be understood that the fluid flow rate can be determined by any of a variety of fluid flow meters, not necessarily a dual-mode flow meter. The minimum fluid flow rate is, again, set by a wide variety of factors. However, continuing with the illustrative example, in one case the minimum fluid flow rate can be between about one and about ten gallons per minute.

If, at step 70, the fluid flow is below the minimum flow rate, at step 72 it is checked whether the fluid pump up timer has expired. In the illustrative example, the pump up timer can range from about one minute to about ninety minutes, with thirty minutes expected to be a typical number in some cases. If the fluid pump up timer has not expired, the system proceeds to step 74 and waits a safety check time, typically a few minutes in the illustrative example. The system resides in the safety check time 74 to provide the pump 12 time to conduct additional pumping operations, allowing the fluid flow to stabilize a bit, and allowing any air pockets to pass through before the fluid flow rate is again checked.

The system then returns to step 70. If, at step 70, the fluid flow is still below the minimum level and, at step 72, the fluid pump up timer has expired, then the system proceeds to step 76 wherein a "low target action" is executed. The low target action may be selected by the operator of the pump/well, and can constitute, for example, a shut down of the pump 12/pump system 10, running the pump 12 at some minimum speed, continuing to pump at the last or current speed of the pump 12, etc. In some cases, the pump 12 may be shut down, although in other cases it may be desired to avoid a total shut down of the pump 12/pump system 10 to ensure some fluid flow continues in order to avoid loss of production of the well due to freezing or certain other conditions.

Returning to step 70, if the fluid flow exceeds the minimum level, then the system proceeds to step 78, effectively exiting the start up phase. At step 78, the reoptimize timer is started, and the reoptimize state flag is set to false. At step 80, the system checks whether the pump 12 is operating at its maximum effective speed. As will become clear in the description below, the maximum effective speed can be considered the highest speed at which the pump 12 can operate without becoming pumped off for the current well conditions. As will be further described below, the maximum effective speed of the pump 12 can be varied to maximize the output of the pump 12 while still providing sufficient fluid flow. However, for initialization purposes a maximum effective speed may be selected based upon calculations and/or past experiences. In the illustrative case, for example, the maximum effective speed is initially set to 180 rpms.

If, at step 80, it is determined the pump 12 is operating below the maximum effective speed, the system advances to step 82, wherein the system resides for the speed adjust time, to allow the system 10/pump 12 to stabilize after any previous adjustments. Similar to the safety check time at step 74, the speed adjust time of step 82 can vary, but in the illustrative example typically is in the range of a few minutes. The speed adjust time can be the same as, or different from, the safety check time.

Next, at step 84, the pump speed is increased by a speed adjust step. The magnitude of the speed adjust step can vary, but in one case in the illustrative example is between about 10-25 rpms. The system then advances to step 86, wherein the rate of fluid flow is checked. At step 86, if the fluid flow is at or above the minimum fluid flow rate, the system advances to step 88, wherein the state of the reoptimize flag is checked. The purpose of the reoptimize flag will be described in greater detail below. However, the illustrative system begins with a reoptimize flag initially being set to "false", as set in step 78. Accordingly, in this case, the system returns to step 80, where the speed of the pump 12 is checked.

If, at step 80, the pump 12 is at or above the maximum effective speed, the system proceeds to step 90 to determine if the reoptimize timer has expired. The reoptimize timer is typically set to a relatively long period of time to allow short and medium fluctuations in the system 10 to dissipate. For example, in the illustrative case, the reoptimize timer is set to last several hours, days, a week or more but can be shorter or longer as desired. If the reoptimize timer has not expired, then the system proceeds to step 86.

If, on the other hand, the reoptimize timer has expired, the system proceeds to step 92 where the pump speed is set to its absolute maximum speed, and the reoptimize state flag is set to "true". In this case, then, the pump 12 is set to a high operating speed, typically at or close to the maximum speed that the pumping system can handle (such as within about 10% in one case, or about 20% in another case, or about 30% in yet another case, of the absolute maximum speed). The absolute maximum speed may be determined by certain limitations in the system 10, for example, top speed of the motor 30/32 and/or the pump 12, the ability of the various pipes and other mechanical components within the system 10 to accommodate high speed fluid flow, safety or regulatory limits, operator desires or the like. The absolute maximum speed may also, or instead, be the top speed during operation of the pump 12; that is, during normal operation of the pump 12 the speed which is not exceeded, or a speed which cannot be exceeded and such that the pump 12 continues operating properly for an extended period of time. In the illustrative example, the absolute maximum speed is about 300 rpm.

This increase in speed at step 92 can, depending upon the current operating conditions, represent a significant increase in speed of the pump 12, and more than a simple "step up" which might be implemented in other systems. For example, in one case the increase in speed my be at least about a 30%, or at least about 50%, increase in speed over the current speed of the pump.

At step 94, which is optional, the system may wait a reoptimize sense interval to allow the effects of the speed increase to be felt. The reoptimize sense interval can range, in one embodiment, between about 5 and about 60 minutes, and may be the same as, or different from, the speed adjust time, pump up timer, and/or safety check time. The rate of fluid flow is then checked at step 86 and compared to the minimum flow rate. If minimum fluid flow rate is met, and the reoptimize state flag is "true" as checked at step 88, then the system proceeds to step 96, and the maximum effective speed is set to the current pump speed. Thus, if the absolute maximum speed is determined to provide sufficient fluid flow, the maximum effective speed is set to the absolute maximum speed of the system. The system then returns to step 80.

Returning to step 86, if the fluid flow at step 86 is below the minimum flow rate (i.e., after the pump is set to the absolute maximum speed, or at any other appropriate time during operation of the pump), at step 98 the maximum low target timer is started. The maximum low target time may be the same as, or different from, the length of the reoptimize sense interval, speed adjust time, safety check time or pump-up timer. It is next determined, at step 100, if the maximum low target time has expired.

If the maximum low target time has not expired, then at step 102, the pump speed is decreased by the speed adjust step and the system moves to step 103 where the maximum effective speed is set to the current pump speed. At step 104 the system resides for the remedy interval. The remedy interval can be the same as, or different from, the safety check time, pump up timer, speed adjust time, reoptimize sense interval, and may be several minutes in the illustrative example. The system then advances to step 106, wherein the fluid flow rate is compared to the minimum fluid flow rate. If the fluid flow rate is not sufficiently high, the system returns to step 100. On the other hand, if the fluid flow rate is sufficiently high, the system proceeds to step 88. In this manner, the system seeks to step down the speed of the system until the minimum flow rate is achieved.

If, at step 100 the maximum low target time has expired, then it is assumed that sufficient fluid flow has not been generated in sufficient time, and corrective action is required. In this case, the system proceeds to step 108 and the low target action is carried out. The corrective action at step 108 can be the same as, or different from, the corrective action described above in the context of step 76.

Figure 4:
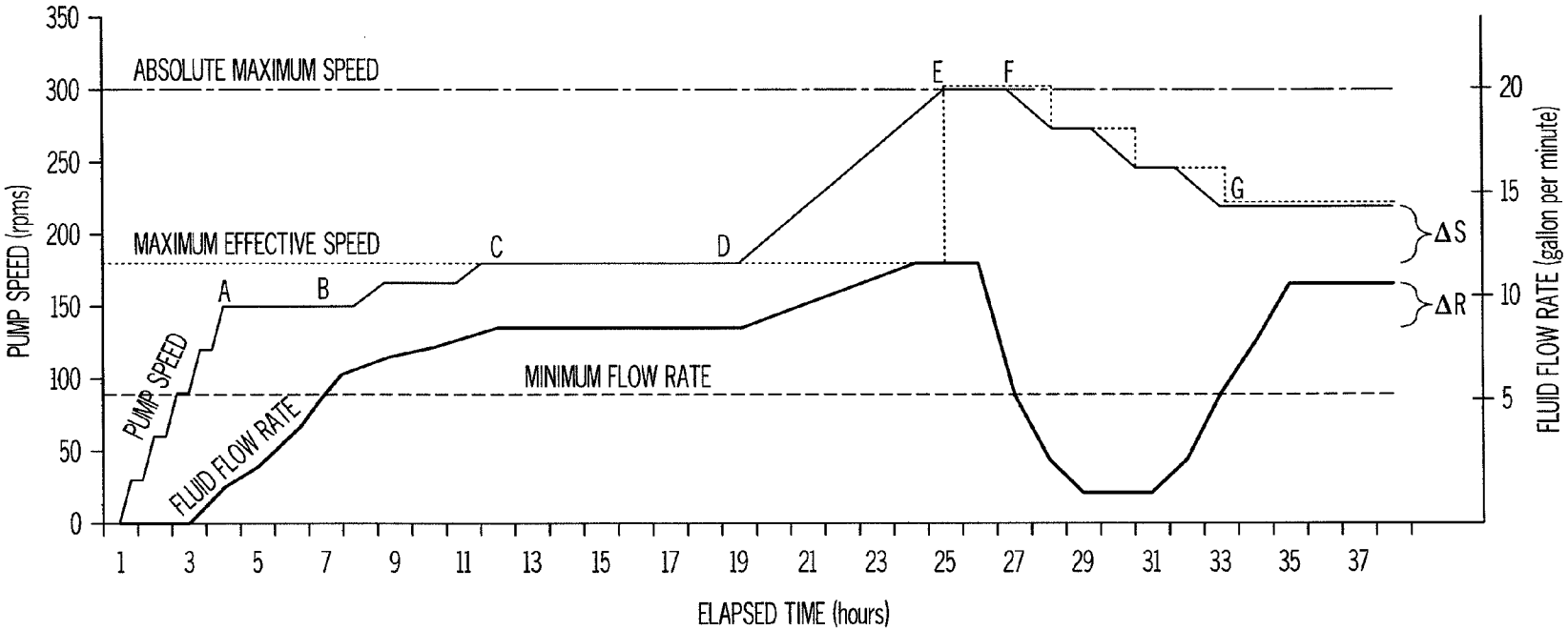
FIG. 4 is a graph illustrating various parameters of a pump system operated via the algorithm of FIG. 3 under a first set of operating conditions.

An example of implementation of the algorithm of FIG. 3 is shown in the graph of FIG. 4. FIG. 4 illustrates variance of speed of the pump 12 (also known as the rod speed) and the maximum effective speed. The graph also illustrates the fluid flow rate of the pump 12, along with the minimum flow rate. As the system progresses to point A of the graph, the pump 12 is in its start up phase and the pump speed increases in steps (or alternately, generally linearly) from 0 to approximately 150 rpms. During this phase, the fluid flow rate increases generally linearly, although the increase of the fluid flow rate may lag behind the pump speed due to the time required for fluid to reach the surface of the well. From point A to B, the fluid flow is checked to see whether it exceeds the minimum flow rate, (i.e., steps 70, 72 and 74 of FIG. 3), allowing the fluid flow rate to increase sufficiently.

Once the fluid flow exceeds the minimum level (at point B), the system exits the start up phase and ramps up to the maximum effective speed, as implemented by steps 80, 82 and 84 of FIG. 3. Once the maximum effective speed is reached at point C of FIG. 4, the system resides at that speed until, at point D, the reoptimize interval has expired.

At point D, once the reoptimize interval has expired, the pump speed is set to its absolute maximum speed and the fluid flow rate correspondingly increases. Although the pump speed is set to the absolute maximum speed at point D, as can be seen, the pump 12 may not be able react instantaneously and must ramp up to the absolute maximum speed between points D and E. At point E, after the absolute maximum speed has been achieved, the fluid flow rate is above the minimum flow rate (step 86), and the reoptimize state is true (step 88) so the maximum effective speed is increased to the absolute maximum speed (i.e. at step 96 of FIG. 3).

At point F, the fluid flow rate falls below the minimum level, and the speed of the pump and maximum effective speed are correspondingly stepped down (according to steps 102 and 103 of FIG. 3) until fluid rate increases above the minimum flow rate, which occurs at point G. The system then reaches stability at point G at which the new optimum speed is discovered.

Thus as can be seen in this example, the reoptimize process has effectively increased the pump speed from about 180 rpms (at point D) to about 230 rpms (at point G), shown as $\Delta S$ in FIG. 4. The reoptimize process has also increased the flow rate, and therefore production, by the increase shown as $\Delta R$ in FIG. 4. Accordingly, the reoptimize process results in increased production which might otherwise not be realized.

The system may then reside in the state shown at point G until the reoptimize process is carried out again (unless fluid output falls below the minimum flow rate). Thus, the reoptimize process periodically increases the pump speed to its absolute maximum speed, and steps down, as necessary, to ensure maximum production is achieved, while ensuring the pump 12 is not damaged. Thus, this algorithm is different from many others in that the speed of the pump 12 is increased to the absolute maximum, and then reduced, as necessary, as opposed to stepping up to reach the maximum effective speed. Immediately increasing to the maximum speed, and then stepping down as necessary, is believed to maximize effective speed increases and therefore provide increased production.

The system may carry out the reoptimize process at various times. For example, as outlined above the reoptimize process may occur at regular intervals. Each time interval may be measured from a starting point, i.e. the reoptimize process may commence a certain period of time (a waiting period) after the starting point. In the scenario outlined above the starting point would be the start/end of the previous reoptimize process. However, the start point for the reoptimize timer can be set/trigged by various other events, such as, for example, a specific time (i.e. 5 am), or a time at which the reoptimize process was previously implemented, or a time at which it was previously determined that a minimum rate of fluid flow was (or was not) being generated by the pump, or a time at which it was determined that the pump was (or was not) at the maximum effective speed, etc. Alternately, the reoptimize process may be set to be carried out a predetermined times; i.e. at 3 pm every third day; at 12 pm every day, etc. The waiting period (elapsed time measured after the starting point) can be a fixed period of time or changed based upon certain operating characteristics of the pump, or based upon operator desires.

Figure 5:
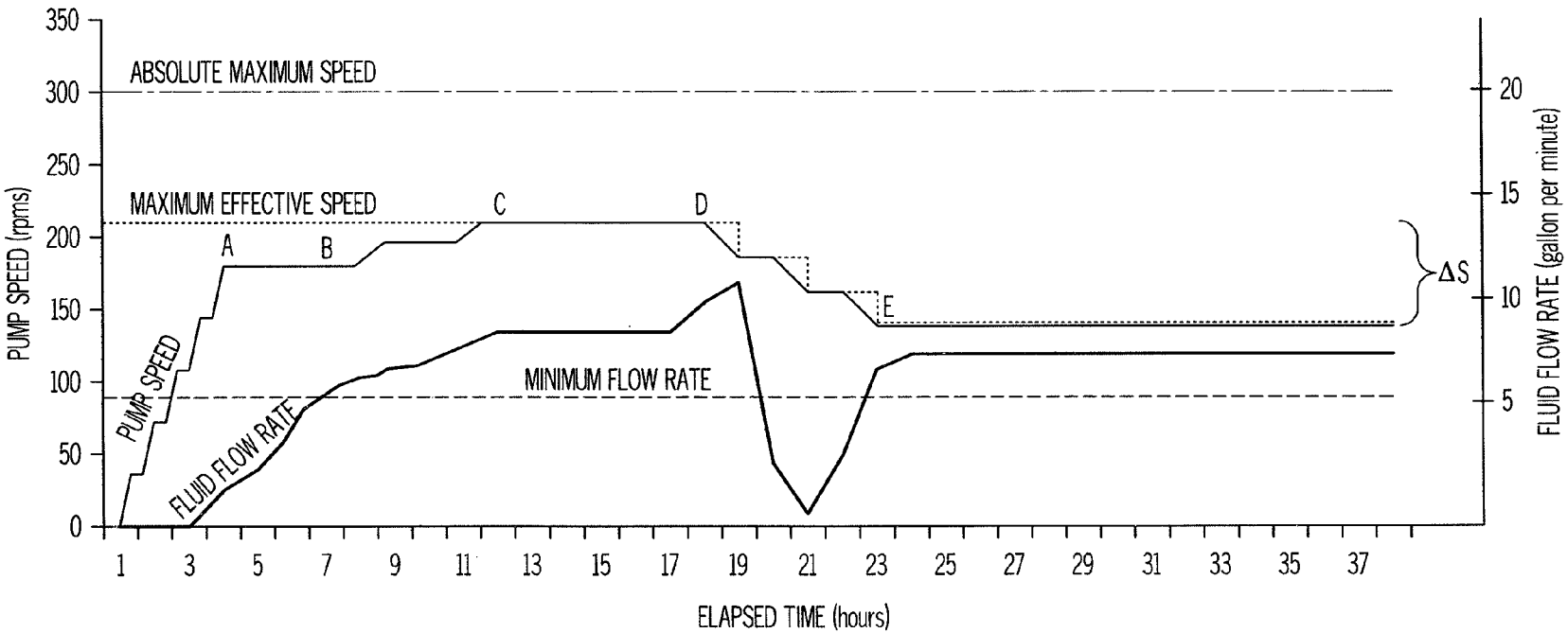
FIG. 5 is a graph illustrating various parameters of a pump system operated via the algorithm of FIG. 3 under a second set of operating conditions.

FIG. 5 provides a graph illustrating various parameters of a pump under differing operating conditions than those shown in FIG. 4. In particular, at point A of FIG. 5, the initial speed up of the pump 12 is completed. At point B, the minimum flow rate is exceeded and the start-up phase is exited. At point C, the pump 12 has been increased to its maximum effective speed. However, at point D, a decrease in flow rate is anticipated, thereby causing the pump 12 to decrease in speed to avoid pumped off condition, and the maximum effective speed is decreased as indicated at steps 102 and 103 of FIG. 3. At point E, the pump speed has been sufficiently decreased that the minimum flow rate is again exceeded, and this stepped-down speed is set as the new maximum effective speed. ΔS represents the adjustment to the maximum effective speed which is instituted to avoid the pump off condition and protect the pump 12.

It is noted that FIG. 5 illustrates a condition in which the speed of the pump is reduced (i.e., at point D) before the flow rate actually falls below the minimum flow rate. In this case, the controller 28 may implement an algorithm which can predict a decrease in fluid flow rate. In particular, if the pump 12 is pumping gas, such gas tends to expand as it is raised, and such expansion can cause a temporary increase in fluid flow rate as the gas expands and pushes towards the surface. However, such a rapid increase in fluid flow rate, with little to no change in the pump speed, can be taken as an indication that there is gas in the pump system 10, and that the fluid flow rate will soon decrease. For example, an increase of between about 10-30%, or about 15% in one case, in the fluid flow rate over a time period of from about 20 seconds to 3 minutes, or about 60 seconds in one case, with a less than about 0.05 to 3% change, or about 2% in one case, change in the pump speed, can be taken as a sign that the pump 12 is pumping gas, allowing corrective measures to be taken.

Thus, if the flow or rate of flow of pumped fluids increase without a corresponding increase in speed of the pump 12, it can be taken as a sensor failure or the presence of gas in the system 10. For example, at step 86 and/or 106 of FIG. 3B, rather than simply inquiring whether the fluid flow is at or above the minimum flow rate, it may be asked whether the fluid flow rate is anticipated to drop below the minimum flow rate, such as by the methodologies described above. The system may keep track of past measured flow rates and thus can look back to compare current fluid flow rates to previous fluid flow rates. The amount of head pressure that the pump 12 experiences can also effect fluid flow rate. If, for example, a valve is opened or there is a break in flow line then there is less pressure on the pump system 10 and it begins to operate at greater efficiency, with greater fluid flow.

Although the invention is shown and described with respect to certain embodiments, it should be clear that modifications will occur to those skilled in the art upon reading and understanding the specification, and the present invention includes all such modifications.

What is claimed is:

1. A pump system comprising:

a pump configured to pump fluid from a well or down hole;

a sensor configured to sense a fluid production of said pump and provide an output indicative of said fluid production; and a control system operatively coupled to said pump for automatically varying the speed of said pump based upon said output of said sensor system, wherein said control system is configured to increase the speed of said pump to a speed that is at or close to an absolute maximum speed of the pump, as a direct result of a predetermined period of time elapsing, or at a predetermined time, regardless of the production levels of the pump, wherein the control system is configured to receive information relating to the production of fluid while operating at said speed that is at or close to said absolute maximum speed of the bump, and to subsequently decrease the speed of said pump after said increase if said output of said sensor indicates that the pump is not producing fluid at a sufficient rate, and to continue to decrease the speed of said pump until said output of said sensor indicates that the pump is producing fluid flow at said sufficient rate, such that the speed of said pump is increased and subsequently decreased as appropriate to maximize fluid production thereof, and wherein said control system is configured, during said increase in speed when said predetermined period of time has elapsed, or at said predetermined time, to increase the speed of said pump to a speed that is at least about 30% over its current speed.

2. The pump system of claim 1 wherein said pump system is configured such that said pump generally cannot exceed said absolute maximum speed and continue operating properly for an extended period of time.

3. The pump system of claim 1 wherein said absolute maximum speed is the pump speed which is not exceeded during normal operation of the pump.

4. The pump system of claim 1 wherein the control system is configured to maintain said pump speed at the speed which produces said sufficient fluid flow rate.

5. The pump system of claim 1 wherein said control system is configured to decrease the speed of said pump when said output of said sensor indicates that the pump is not producing fluid flow at said sufficient rate.

6. The pump system of claim 5 wherein said control system is configured to continue decreasing the speed of said pump until said output of said sensor indicates that the pump is producing sufficient output.

7. The pump system of claim 1 wherein said predetermined period of time is defined by a waiting period of time elapsed after a start time, wherein said start time is a specific time, or a time at which previous increase of the speed of said pump was implemented, or a time at which it was previously determined that a minimum rate of fluid flow was being generated by said pump, or a time at which it was previously determined that a minimum rate of fluid flow was not being generated by said pump, or a time at which it was previously determined that said pump was at a particular speed.

8. The pump system of claim 7 wherein said waiting period of time is a fixed amount of time that is unrelated to the production or operation of the pump.

9. The pump system of claim 1 wherein said sensor is configured to sense a rate of fluid flow output by said pump and wherein said output of said sensor is indicative of said rate of fluid flow output by said pump.

10. The pump system of claim 9 wherein said sensor is configured to use at least two discrete methodologies for measuring said fluid flow rate.

11. The pump system of claim 1 wherein said control system is configured to increase the speed of said pump solely based upon and as a direct result of said predetermined period of time elapsing, or solely based upon and as a direct result of said predetermined time occurring.

12. The pump system of claim 1 wherein said control system is configured to always increase the speed of said pump as a direct result of said predetermined period of time elapsing or at said predetermined time regardless of the production of the pump.

13. The pump system of claim 1 wherein said control system is configured to increase the speed of said pump to said absolute maximum speed at the same time each day.

14. The pump system of claim 1 wherein said control system is configured to increase the speed of said pump to said absolute maximum speed at a predetermined time after the pump was last increased to said absolute maximum speed.

15. A pump system comprising:

a pump;

a sensor configured to sense a fluid production of said pump and provide an output indicative of said fluid production; and a control system operatively coupled to said pump for automatically varying the speed of said pump at least partially based upon said output of said sensor system, wherein said control system is configured to increase the speed of said pump as a direct result of a predetermined period of time elapsing, or at a predetermined time, regardless of the fluid production of said pump to a speed at or close to an absolute maximum speed of the pump system, and to receive information relating to the production of fluid while operating at said increased speed, wherein said control system is configured to subsequently decrease the speed of said pump, after said increase of speed, if said output of said sensor indicates that the pump is producing fluid at a sufficiently low rate.

16. The system of claim 15 wherein said control system is configured to periodically increase, at regular time intervals, the speed of said pump to a speed at or close to an absolute maximum speed of the pump system.

17. The pump system of claim 15 wherein said control system is configured to continue to decrease the speed of said pump, until said output of said sensor indicates that the pump is producing fluid flow at said sufficient rate.

18. A method for operating a pump system including a pump, a sensor configured to sense a fluid production of said pump and provide an output indicative of said fluid production, and a control system operatively coupled to said pump and to said sensor, the method comprising the control system automatically carrying out the following steps:

increasing the speed of said pump as a direct result of a predetermined period of time elapsing, or at a predetermined time, regardless of a fluid production of said pump;

monitoring the fluid production of said pump by said sensor;

automatically decreasing the speed of said pump by said control system if said output of said sensor indicates that the pump is producing fluid at a sufficiently low rate; and continue to decrease the speed of said pump until said output of said sensor indicates that the pump is producing fluid flow at said sufficient rate.

19. The method of claim 18 wherein said increasing step includes increasing the speed to a speed at or close to an absolute maximum speed of the pump system.

20. The method of claim 18 wherein said control system is configured to automatically vary the speed of said pump at least partially based upon said output of said sensor system.

21. A method for operating a pump system comprising:

accessing a pump system including a pump and a sensor configured to sense a fluid production of said pump;

after a predetermined period of time has elapsed, or at a predetermined time, increasing the speed of said pump to a speed that is at or close to a maximum operating speed of the pump regardless of a fluid production of said pump;

once the pump speed is increased to the speed that is at or close to the maximum operating speed of the pump, monitoring a fluid production of said pump by said sensor;

in response to said sensor indicating that the pump is producing fluid at a sufficiently low rate, automatically decreasing the speed of said pump; and continuing to decrease the speed of said pump until the pump is operating at a new speed at which said sensor indicates that the pump is producing fluid flow at said sufficient rate; and operating said pump at said new speed as a set point speed;

wherein the increasing, monitoring, decreasing, and continuing to decrease steps result in an increased production of the pump, $\Delta R$, compared to the production of the pump before the increasing, monitoring, decreasing, and continuing to decrease steps were carried out.

22. A method of operating a pump disposed in a well in communication with a reservoir of fluid, comprising the steps of:

(a) configuring a sensor system comprising a sensor to sense said fluid from said reservoir moved by said pump;

(b) coupling a control system comprising a controller with said sensor system;

(c) pumping said fluid with said pump, wherein said pump has a speed, and wherein said pumped fluid has a flow rate;

(d) operating said pump at a first constant speed, wherein said first constant speed is the highest speed at which said pump can operate at the time without becoming pumped-off, and wherein a first constant flow rate is generated by said pump at said first constant speed;

(e) increasing said speed of said pump regardless of said first constant flow rate after a predetermined period of time has elapsed, or at a predetermined time, to a second constant speed, wherein said second constant speed is greater than said first constant speed, and said second constant speed is the highest speed that said pump can continuously operate;

(f) increasing said flow rate after the step of increasing said speed of said pump to said second constant speed;

(g) monitoring said flow rate with said sensor system after said second constant speed is reached;

(h) maintaining said second constant speed until automatically decreasing said speed of said pump in response to said sensor system indicating that said flow rate is lower than a second flow rate, wherein said second flow rate is lower than said first constant flow rate;

(i) continuing to decrease said speed of said pump until said pump is operating at a third constant speed at which said sensor system indicates that said flow rate is a third constant flow rate greater than said first constant flow rate; and (j) operating said pump at said third constant speed.

23. The method of claim 22, further comprising the steps of:

repeating steps (c) through (j) after a predetermined period of time has elapsed, or at a predetermined time.

24. A method of operating a pump disposed in a well in communication with a reservoir of fluid, comprising the steps of:

(a) configuring a sensor system comprising a sensor to sense said fluid from said reservoir moved by said pump;

(b) coupling a control system comprising a controller with said sensor system;

(c) pumping said fluid with said pump, wherein said pump has a speed, and wherein said pumped fluid has a flow rate;

(d) operating said pump at a first constant speed, wherein said first constant speed is the highest speed at which said pump can operate at the time without becoming pumped-off, and wherein a first constant flow rate is generated by said pump at said first constant speed;

(e) maintaining said first constant speed until said sensor system indicates that an increase in said first constant flow rate has occurred at a time when no change in said first constant speed has occurred, and in response, automatically decreasing said speed of said pump;

(f) continuing to decrease said speed of said pump until said pump is operating at a second constant speed at which said sensor system indicates that said flow rate is a second constant flow rate greater than a minimum constant flow rate; and (g) operating said pump at said second constant speed.

25. The method of claim 24, wherein said increase in said first constant flow rate in step (e) is greater than 10% over said first constant flow rate during a time period of greater than 20 seconds.

* * * * *

UNITED STATES PATENT AND TRADEMARK OFFICE

CERTIFICATE OF CORRECTION

PATENT NO. : 8,529,214 B2
APPLICATION NO. : 12/722130
DATED : September 10, 2013
INVENTOR(S) : Michael E. Smith It is certified that error appears in the above-identified patent and that said Letters Patent is hereby corrected as shown below:

In the Claims:

Column 10, Claim 1, Line 9, reads: "maximum speed of the bump and to subsequently"

It should read -- maximum speed of the pump and to subsequently --

Signed and Sealed this
Twenty-sixth Day of November, 2013

Margaret A. Focarino

Margaret A. Focarino
*Commissioner for Patents of the United States Patent and Trademark Office*